US005501284A

United States Patent [19]

Clodfelter et al.

[11] Patent Number: 5,501,284

[45] Date of Patent: Mar. 26, 1996

[54] INFLATABLE BAG FIRE EXTINGUISHING SYSTEM

[76] Inventors: Robert G. Clodfelter, 7813 Port Cir., Centerville, Ohio 45459-4106; Benito Botteri, 2398 Red Apple Dr., Dayton, Ohio 45431

[21] Appl. No.: 232,515

[22] Filed: Apr. 22, 1994

[51] Int. Cl.[6] ..... A62C 3/08

[52] U.S. Cl. ..... 169/54; 169/61; 169/62; 60/39.091; 239/533.13; 244/129.2

[58] Field of Search ..... 169/48, 54, 60, 169/61, 62, 64; 239/533.13, 602; 244/129.2; 60/39.091; 454/257

[56] References Cited

U.S. PATENT DOCUMENTS

| | | | |
|---|---|---|---|
| 818,938 | 4/1906 | Crane | 239/602 X |
| 2,693,240 | 11/1954 | Glendinning et al. | 169/45 |
| 3,268,009 | 8/1963 | Bussey et al. | 169/16 |
| 3,708,194 | 1/1973 | Amit | 162/62 X |
| 3,752,501 | 8/1973 | Daniel et al. | 280/729 |
| 3,788,666 | 1/1974 | Kramer et al. | 169/62 X |
| 3,831,318 | 8/1974 | Richmond | 169/64 X |
| 3,915,237 | 10/1975 | Roznicki | 169/62 |
| 3,990,464 | 11/1976 | Jenkins | 169/48 X |
| 4,702,322 | 10/1987 | Richardson | 169/28 |
| 4,763,731 | 8/1988 | Adams et al. | 169/46 |
| 4,828,286 | 5/1989 | Föhl | 280/731 |

FOREIGN PATENT DOCUMENTS

| | | | |
|---|---|---|---|
| 2202142 | 9/1988 | United Kingdom | 169/62 |
| 2255502 | 11/1992 | United Kingdom | 169/62 |

*Primary Examiner*—Andrew C. Pike

[57] ABSTRACT

A fire extinguishing apparatus for use in normally ventilated or confined spaces of, for example, vehicles, such as an aircraft engine compartment, has an inflatable bag to enhance extinguishing agent performance. The inflatable bag is connected to a source of gaseous or vaporizable liquid fire extinguishing agent which upon discharge flows to the bag resulting in its deployment into the compartment. The bag is configured to block the normal compartment ventilating air path while allowing for dispersal of agent from the bag into the compartment to effect extinguishment.

12 Claims, 3 Drawing Sheets

INFLATABLE BAG FIRE EXTINGUISHING SYSTEM

BACKGROUND OF THE INVENTION

1. Field of Invention

This invention relates to fire protection systems and specifically to a novel inflatable bag apparatus for deploying gaseous and vaporizable fire extinguishing and explosion suppression agents.

2. Prior Art

Several basic mechanisms for effecting fire extinguishing and explosion suppression for various combustible fuel/oxidizer combinations exist. These are: (a) separation of fuel from the oxidizer (typically air) e.g. mechanical fire fighting foam agents; (b) dilution of oxidizer to a concentration below which it cannot support combustion e.g. with an inert gas such as helium; (c) cooling of the reactants (fuel and oxidizer) and sufficient absorption of the thermal energy output to quench the combustion process e.g. by application of water spray; and (d) the chemical inhibition of the production of free radicals essential to the sustenance of the combustion process e.g. by a chemical agent such as bromotrifluoromethane (CF3Br). Agent selection, storage, quantity and dispensing method are affected by the particular fire protection problem or application which, in turn, dictates operational (environment; habitable vs. non- habitable, etc.) and system weight, volume and cost constraints, e.g. ground facilities versus aircraft applications.

In general, fire extinguishing agents are applied in either (a) a local application mode such as from a portable hand held fire extinguisher or from a turret on a fire fighting vehicle, or (b) a total flooding mode such as by the rapid distribution of a fire extinguishing agent via fixed nozzles into a confined space so as to achieve a concentration level in air throughout the entire volume sufficient for fire extinguishment.

Modern aircraft turbine engine installations are representative of a confined space fire protection application and are considered natural "fire zones" because of the inherent presence of an ignition source(s) and the close proximity of flammable/combustible fluids such as jet fuel, engine oil and, in many instances, hydraulic fluid. The "fire zone" designation requires that overheat/fire detection and in the case of most multiengine aircraft, fire extinguishing systems be provided for protection of crew, passengers and equipment. These protection systems are in addition to the rigorous application of fire prevention and hardening measures such as unidirectional, high velocity air flow to purge volatile combustible fluid leaks while also reducing the likelihood of hot surface ignition, and suitable fire walls to prevent fire penetration into adjacent compartments. Fire detection systems respond in the matter of a few seconds. Fire extinguishing systems once activated also respond very rapidly and are designed to discharge a halon chemical fire extinguishing agent such as bromotrifluoromethane ($CF_3Br$) into the compartment so as to achieve a certain minimum volume percent concentration (6% for $CF_3Br$; varies with the particular agent used) simultaneously at all locations in the engine compartment and hold that concentration for a short time (approximately 0.5 second) to achieve extinguishment. The fire extinguishing system typically entails a bottle to store the fire extinguishing agent under pressure, an open ended distribution conduit leading to an appropriate location within the "fire zone" and an electro-mechanical valve or electro-explosive (squib) rupture diaphragm incorporated into the neck of the bottle for triggering release of the agent. No provision is incorporated to terminate engine compartment ventilation air in the event of fire; consequently, determination of agent quantity requirements for a particular installation entails consideration of several factors but, in particular, engine compartment free volume and ventilating air flow (as a function of flight profile). Overall agent effectiveness is reduced (quantity increased) by agent leakage out and/or air leakage into the fire control area thereby decreasing agent dwell time and by agent/air mixing inefficiencies. No apparatus is known, however, which simultaneously overcomes these agent/air mixing inefficiencies.

Military and civil aircraft currently employ halon agents such as bromotrifluoromethane (Halon 1301) and bromochlorodifluoromethane (Halon 1211) in on-board fire extinguishing systems for the protection of engine installations and other areas designated as "fire zones". These agents evolved from industry and principally Department of Defense (DOD) research and development efforts which were begun in the 1950's and provide outstanding fire extinguishing effectiveness and other favorable toxicologic, operational and system attributes which made them essentially the "universal" choice for these applications. Unfortunately, these same extinguishants, upon release into the atmosphere, have been tabbed in recent years to possess characteristics which make them extremely bad actors from the standpoint of depleting the "critical" ozone level in the earth's stratosphere and consequently has led to an international ban on their future production. Effective (cost and performance) alternative fire protection techniques are urgently needed for aircraft flight safety and survivability to fill the void resulting from the banning of these halon "chemical" extinguishants.

There are several on-going efforts which are directed at the identification and evaluation of alternative and replacement materials for the Halon 1301 and 1211 agents for both aircraft and ground fire protection applications. Candidates under consideration include perfluorocarbons, hydrofluorocarbons, hydrochlorofluorocarbons, hydrobromofluorocarbons, iodofluorocarbons, dry chemicals, carbon dioxide, nitrogen and mixtures of basically inert gases. It is generally accepted that the development of "true" replacements for halons 1301 and 1211 for aircraft and ground applications is not imminent.

SUMMARY OF THE INVENTION

The principal objective of this invention is to provide an improved fire extinguishing apparatus or system which is capable of enhancing the effectiveness of various gaseous and vaporizable fire extinguishing agents for ventilated and confined space compartments/volumes fire scenarios by essentially reducing the availability of oxidizer (normally air) and increasing agent dwell (staying) time.

This invention provides a means of overcoming the inherent short-fall in fire extinguishant effectiveness associated with current alternative agents while at the same time being amenable to the integration of chemical fire extinguishing agent advancements made by others, especially the vaporizing liquid and gaseous types of agents.

Another object is to provide an apparatus which offers compact and lightweight storability while also offering design flexibility to accommodate varying volume and configuration fire protection applications.

A further objective is to provide an apparatus which is amenable to various materials of construction and deployment configurations to meet the varying environmental, operational and/or space demands of a specific end application.

The foregoing objects can be accomplished by providing an inflatable bag as the final element in the system for fire extinguishing agent distribution. Other objects and many of the associated advantages will readily be appreciated as the subject invention becomes better understood by reference to the following detailed description, when considered in conjunction with the accompanying drawings.

DETAILED DESCRIPTION

Figure 1:
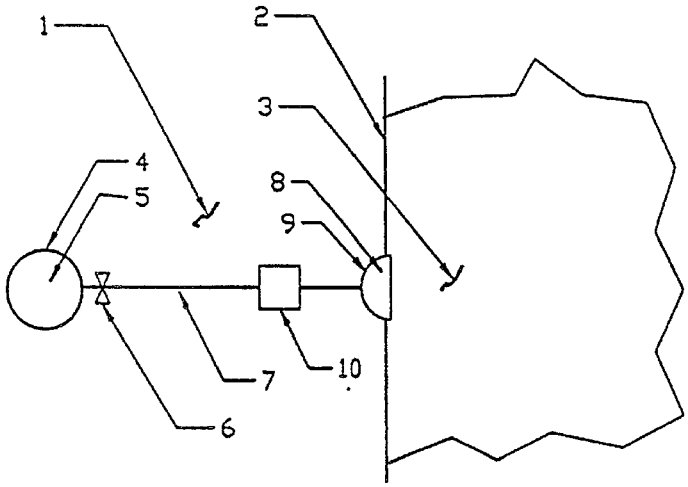
FIG. 1 is a sectional view of a compartment fire extinguishing apparatus embodying the present invention.

In the exemplary form of the invention illustrated in FIG. 1, a novel inflatable bag fire extinguishment apparatus is shown generally at 1 in association with a compartment wall 2 confining a fire zone 3. The apparatus 1 comprises a reservoir (bottle or flask) 4 containing a charge of gaseous vaporizable liquid fire extinguishing agent 5 under pressure. The bottle 4 is equipped with discharge means (an electrically operated release valve or squib actuated rupture diaphragm) 6 and an agent distribution conduit duct 7 connected to an inflatable bag 8 within a storage/release container 9. Upon discharge actuation the bag is rapidly expanded into the compartment (fire zone 3) or air inlet into the fire zone 3 upon discharge actuation 6 resulting in release of the fire extinguishing agent 5 from the bottle 4. Also shown is the inclusion of an air ejector/aspirator 10 in the agent distribution conduit 7 for premixing extinguishing agent 5 with external air at concentrations suitable for fire extinguishment.

Figure 2:
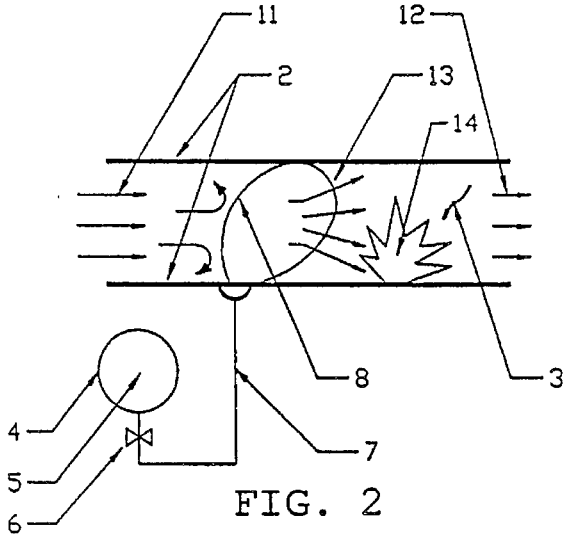
FIG. 2 is a view of the apparatus installed in a typical compartment in the deployed stage.
Figure 3:
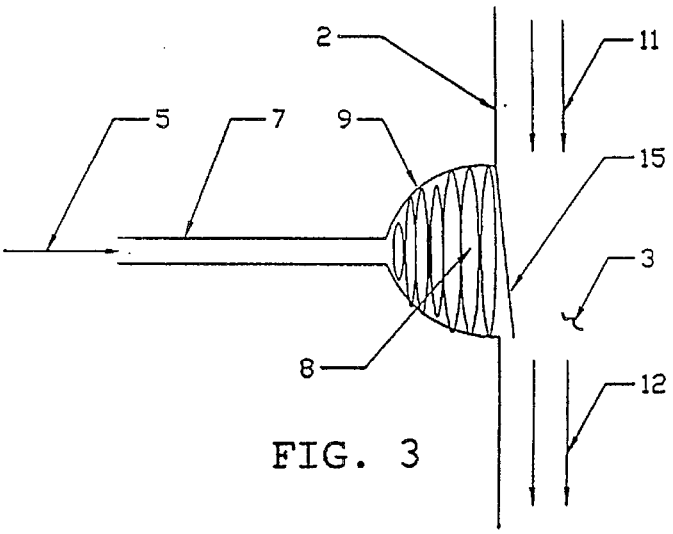
FIG. 3 is an enlarged view of the inflatable bag storage/dispensing container.

The bag 8 is shown in a deployed state in FIG. 2 in a ventilated 11, 12 compartment 2 designated as a fire zone 3. The expanded bag 8 blocks the air flow path 11 and releases fire extinguishing agent thru perforations or pores 13 in the bag material 8 into fire zone 3 to extinguish the fire 14. FIG. 3 provides an enlarged view of a typical bag storage/dispensing container 9, the stowed collapsed inflatable bag 8 and a fire resistant flapper door or protective cover 15 through which the inflatable bag enters the fire zone 3.

Upon detection of a fire in the compartment the system is actuated by control 6 resulting in release of fire extinguishing agent 5 through the distribution conduit 7 into the stowed inflatable bag 8 causing it to emerge thru the flapper door or protective cover 15 and fully inflate into compartment 2 and thereby block incoming ventilating air 11 which is needed to sustain the fire, displacing a portion of the residual air 12 in the compartment and simultaneously dispersing extinguishing agent into the remaining voids within the compartment thru perforations 13 in a portion of the surface of the inflatable bag 8 thereby extinguishing and controlling the fire in the compartment 2. The system accomplishes fire control by employing several of the basic mechanisms described earlier in the Prior Art section of this patent, viz. separation of the oxidizer (air) from the fuel, chemical inhibition of the flame process and cooling of combustion reactants. More importantly, the overall efficiency and effectiveness of the extinguishment process is greatly enhanced by significantly minimizing the agent dilution effects of the ventilating air 11, reducing discharged agent mixing limitations, and increasing agent dwell time within the fire zone area 3.

Figure 4:
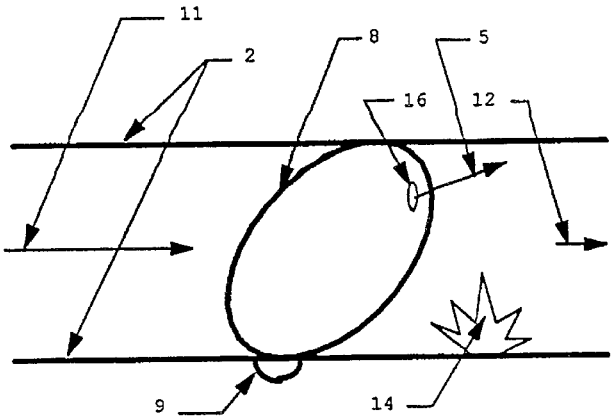
FIG. 4 is a view of an orifice in the inflatable bag for agent release.
Figure 5:
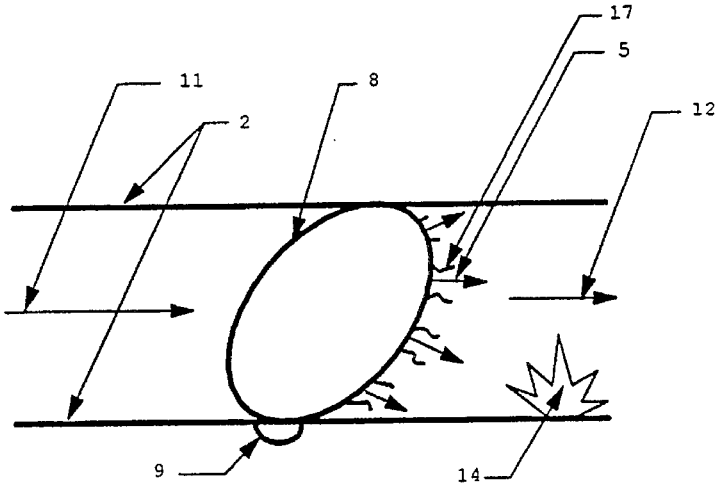
FIG. 5 is a view of inflatable bag rupture for agent release.
Figure 6:
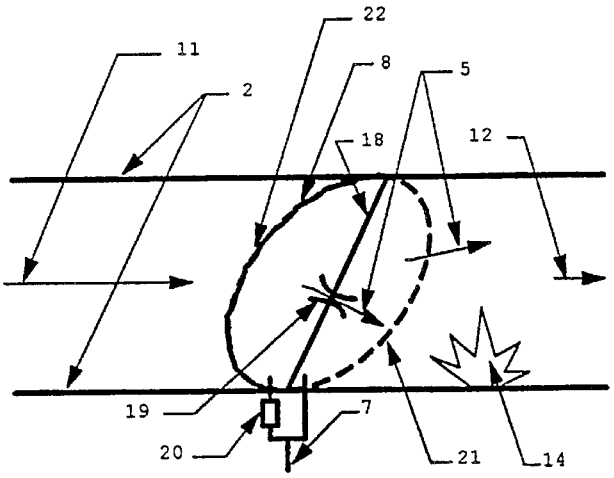
FIG. 6 is a view of a compartmented inflatable bag.
Figure 7:
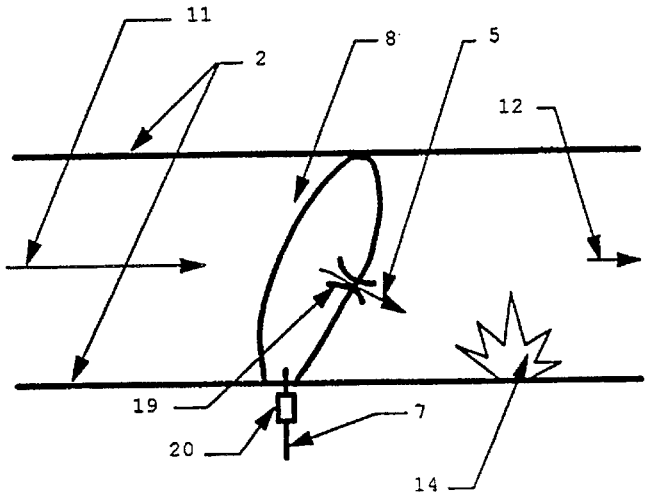
FIG. 7 is a view of a check valve in the inflatable bag for agent release.
Figure 8:
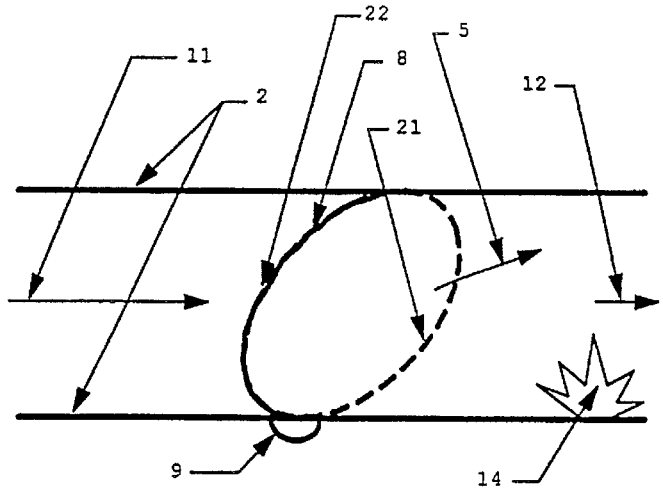
FIG. 8 is a view of an inflatable bag incorporating non-permeable material for blockage of normal ventilating air and permeable material for agent release.
Figure 9:
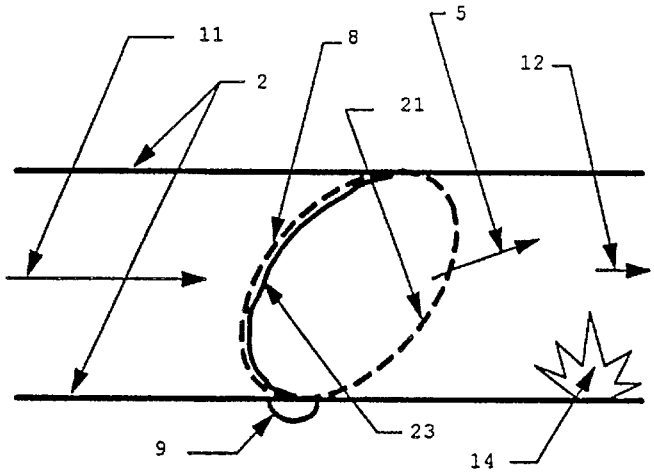
FIG. 9 is a view of an inflatable bag constructed from a permeable material with a non-permeable coating applied on the air blocking surfaces.

FIGS. 4 through 9 contain many of the same components as FIG. 2 for reference and illustrate additional design options. FIG. 4 shows the fire extinguishing agent 5 exiting the bag 8 through a typical orifice 16 (example a button hole) in the bag 8. A bag may contain many orifices 16 on the fire side 14 of the bag 8. FIG. 5 shows a bag 8 which ruptures in a controlled way and discharges fire extinguishing agent 5 into the fire area 14. The bag 8 of FIG. 6 is divided by a non-permeable material 18 which contains a pressure release orifice or check valve 19 and includes a non-permeable material 22 on the upstream side and a permeable material 21 on the downstream side. The agent distribution conduit 7 supplies both compartments of the bag 8. Agent 5 flows from the upstream compartment of the bag 8 through check valve 19 into the downstream compartment of the bag 8 and then exits the bag 8 into the fire area 14. Check valve 19 together with check valve 20 maintains a portion of bag 8 inflated to block air flow even after agent depletion. In FIG. 7 the agent distribution conduit 7 supplies the bag 8. Agent 5 flows from the bag 8 through check valve 19 into the fire area 14. Check valve 19 together with check valve 20 maintains the bag 8 inflated to block air flow even after agent depletion. FIG. 8 shows a bag 8 with the upstream side 22 of the bag 8 constructed of a non-permeable material to prevent agent flow upstream. The downstream side 21 of the bag 8 is constructed of a permeable material to allow agent flow 17 into the fire area 14. The bag 8 of FIG. 9 is constructed of a permeable material 21 with the upstream side of the bag 8 containing a coating of a non-permeable material 23 to prevent agent flow upstream. Additionally, a variety of hybrid bag configurations are possible wherein the bag design can include various combinations of the above features, FIGS. 4 through 9, to accomplish fire extinguishment action.

Lightweight, stowable and strong inflatable bags can be made of a variety of available thermoplastic (i.e. fluoroplastics and polyimides) and elastomeric (i.e. fire resistant neoprene) materials or fabricated from various high temperature, fire resistant fiber materials such as PBI (polybenzimidazole). Fabric materials are available aluminized or with other types of laminates or films to provide a wide range of flame radiation and high temperature resistance properties in conjunction with suitable gas permeability and strength characteristics which make them acceptable for the already well defined fire environment exposure conditions associated with typical organic fuel/air fires. For example, the aircraft engine compartment fire scenario thermal radiation exposure levels expected for the deployed bag would be 12 watts per $cm^2$ for a few seconds.

Bags can be configured to various shapes and volumes as dictated by the specific nature of the particular fire protection application. Available materials also offer a broad range of physical and chemical properties capable of fulfilling both the long term environmental storage and the short term fire exposure requirements dictated by a variety of foreseen fire protection applications. Depending on the specific fire protection application, one or more inflatable bags, possibly of different size and configuration, can be employed for effecting air blocking and agent distribution or for just air blockage. While the above description contains many specificities, these should not be construed as limitations on the scope of the invention, but rather as an exemplification of one preferred embodiment thereof. The compartment 2 is only one example of a location in which the system of the invention may be used to great advantage.

Various alternatives to the pressurized stored gaseous or vaporizing liquid fire extinguishing agent source described in the main illustrated embodiment of our invention are also possible. These alternative sources for gaseous or vaporizable chemical and/or physical inerting agents for example include solid gas generators for the direct production of nitrogen inerting gas and hollow fiber permeable membrane or molecular sieve based generators which produce nitrogen inerting gas by separating it out of the air.

Accordingly, the scope of the invention should be determined not by the embodiment illustrated, but by the appended claims and their legal equivalents.

We claim:

1. An apparatus for extinguishing fire in a confined compartment having a normal flow of ventilating air therethrough, said apparatus comprising:

an inflatable bag mounted in a collapsed condition adjacent the compartment, said bag being configured to be compatible with volume and space geometry of the compartment and having means for dispersing a gaseous or vaporizable liquid fire extinguishing agent;

a normally deactivated source of said gaseous or vaporizable liquid fire extinguishing agent connected to said bag;

and means operatively connected to said source to activate release of said gaseous or vaporizable liquid fire extinguishing agent for inflating the bag resulting in blockage of the normal flow of the ventilating air, displacement of at least a portion of residual air, and dispersal of said agent through the bag into the compartment to effect fire extinguishment.

2. The apparatus of claim 1, wherein said dispersing means comprises a surface portion of said bag through which said agent passes when said bag is inflated.

3. The apparatus of claim 1, wherein said dispersing means comprises a surface portion of said bag which has at least one orifice through which said gaseous or vaporizable liquid extinguishing agent passes when said bag is inflated.

4. The apparatus of claim 1, wherein said dispersing means comprises controlled rupturing of said bag within the compartment by overpressurization with said inflating gaseous or vaporizable liquid fire extinguishing agent.

5. The apparatus of claim 1, wherein said dispersing means comprises a pressure release orifice or a check valve for sustained pressurization of the bag and dispersal of said gaseous or vaporizable liquid fire extinguishing agent.

6. The apparatus of claim 1, wherein said bag is formed of fire resisting materials operable to withstand a thermal radiation exposure of approximately 12 watts per $cm^2$ for at least one second.

7. The apparatus of claim 6, wherein said bag materials comprise non-porous fire resistantb 55017115.001 neoprene or aluminized polybenzimidazole (PBI) fabric on air blocking surfaces of the bag and porous fire resistant polyimide or polybenzimidazole fabric on extinguishing agent dispersal surfaces of the bag.

8. The apparatus of claim 6, wherein said bag comprises a porous fire resistant polyimide or polybenzimidazole fabric and air blocking surfaces of the bag are covered with a non-porous fire resistant coating.

9. The apparatus of claim 1, wherein said inflating means includes means for discharging said gaseous or vaporizable fire extinguishing agent, a conduit connecting said discharging means and said bag, and an ejector/aspirator connected to said conduit to cause mixing of air and said agent to inflate the bag therewith.

10. The apparatus of claim 9, wherein said discharging means includes a reservoir for said gaseous or vaporizable fire extinguishing agent and a valve mechanism for releasing said agent into said conduit.

11. The apparatus of claim 10, wherein said reservoir comprises an extinguishing agent gas generator.

12. The apparatus of claim 1, wherein said gaseous or vaporizable liquid fire extinguishing agent comprises the group consisting of perfluorocarbons, hydrofluorocarbons, hydrochlorofluorocarbons, hydrobromofluorocarbons, iodofluorocarbons, carbon dioxide, nitrogen, and mixtures of inert gases.

* * * * *